United States Patent [19]

Greenberg

[11] Patent Number: 4,796,166

[45] Date of Patent: Jan. 3, 1989

[54] HALOGEN SPOTLIGHT ASSEMBLY FOR CEILING FAN

[75] Inventor: Shelley A. Greenberg, Encino, Calif.

[73] Assignee: Beverly Hills Trading Company, Inc., Los Angeles, Calif.

[21] Appl. No.: 117,500

[22] Filed: Nov. 6, 1987

[51] Int. Cl.[4] ..... F21S 1/04

[52] U.S. Cl. ..... 362/96; 362/294; 362/405

[58] Field of Search ..... 362/96, 249, 294, 404, 362/405, 406; 416/5

[56] References Cited

U.S. PATENT DOCUMENTS

| | | | |
|---|---|---|---|
| 986,550 | 3/1911 | Cuming | 362/405 X |
| 1,663,656 | 3/1928 | Guth | 362/406 X |
| 4,363,083 | 12/1982 | Tanaka et al. | 362/294 X |
| 4,402,649 | 9/1983 | Laurel | 416/5 |
| 4,426,677 | 1/1984 | Dennis | 362/294 X |
| 4,428,032 | 1/1984 | Workman | 362/96 |
| 4,631,651 | 12/1986 | Bergin et al. | 362/267 |
| 4,685,038 | 8/1987 | Huang | 362/406 X |

FOREIGN PATENT DOCUMENTS

| | | | |
|---|---|---|---|
| 833331 | 3/1952 | Fed. Rep. of Germany | 362/405 |
| 7408338 | 12/1975 | Netherlands | 362/405 |

*Primary Examiner*—Ira S. Lazarus
*Assistant Examiner*—Richard R. Cole
*Attorney, Agent, or Firm*—Bernard, Rothwell & Brown

[57] ABSTRACT

A halogen spotlight device for an electrically operated ceiling fan includes a spotlight base portion configured for attachment to a switch housing of the ceiling fan. At least one spotlight body for housing a halogen bulb is mounted on the spotlight base portion by a pivoting connector, the spotlight body having a light outlet. A transformer for converting 120 volts to 12 volts has an input connected to a 120 volt household line by a switch, and an output connected to the halogen bulb in the spotlight body by a corresponding socket, for providing a 12 volt electric current to operate the halogen bulb.

10 Claims, 1 Drawing Sheet

HALOGEN SPOTLIGHT ASSEMBLY FOR CEILING FAN

BACKGROUND OF THE INVENTION

1. Field of the Invention

The present invention relates to a lighting assembly for mounting on a ceiling fan.

2. Description of the Background Art

Ceiling fans are useful devices for circulating air in a room and maintaining a comfortable environment. Often, a ceiling fan is installed by replacing a previously installed overhead light fixture.

Replacement of an overhead light fixture with only a ceiling fan results in a concomitant decrease in the amount of light available for illuminating a room. Accordingly, ceiling fans often are provided with light fixtures that are operated with electricity supplied through the ceiling fan to provide additional illumination in a room, see, e.g., U.S. Pat. No. 4,428,032 to Workman. Generally, ceiling fan light fixtures use incandescent bulbs, which may provide insufficient light for comfortable reading or study without eye strain.

It is also known to utilize an annular fluorescent lightbulb disposed within a translucent ceiling fan housing for illumination, see, e.g., U.S. Pat. No. 4,402,649. However, the diffused light produced by such an arrangement may also be insufficient for comfortable reading and study without eye strain, as there is no provision for directing light where it is specifically needed.

There remains a need in the art for a lighting device for mounting on a ceiling fan that provides brightly illuminating light that can be directed to a particularly desired location.

SUMMARY OF THE INVENTION

In accordance with the present invention, a halogen spotlight assembly for mounting on a ceiling fan comprises a spotlight base portion configured for attachment to a switch housing of a ceiling fan. At least one spotlight body having a light outlet is provided for housing a halogen bulb, the spotlight body being mounted on the spotlight base portion by a pivoting connector. Electric transformer means having an input and an output are provided for converting 120 volt electric household current to 12 volt electric current, for operating a corresponding halogen bulb within the spotlight body. A switch is connected to the transformer input, the switch having means for connecting to a household electric line for selectively connecting the transformer thereto. A socket is provided for mating with a corresponding halogen bulb within the spotlight, the socket being connected to the transformer output for connecting the transformer output to the corresponding halogen bulb.

DETAILED DESCRIPTION OF THE PREFERRED EMBODIMENT

Until the present invention, light fixtures for ceiling fans were restricted to the use of incandescent lightbulbs, and less frequently, fluorescent lightbulbs, because light fixtures for ceiling fans utilize household current, which in the United States is about 120 volts AC. There is no suggestion in the prior art to utilize halogen bulbs, which require approximately 12 volt electric current, as it was not known if the problems associated with providing a halogen light fixture for a ceiling fan operated by household electricity, such as destructive build-up of heat, could be overcome to produce a commercially feasible product having consumer appeal.

Figure 1:
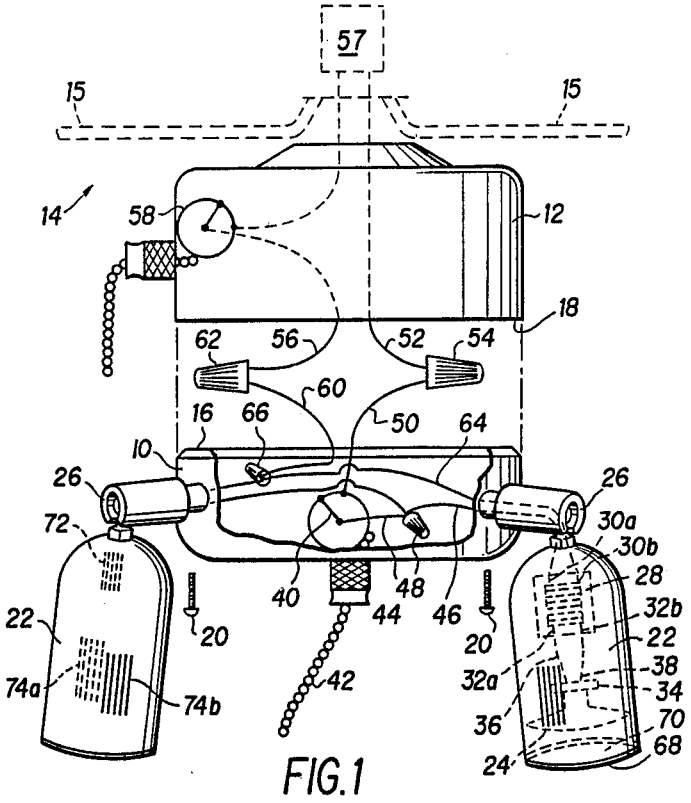
FIG. 1 is a partly schematic elevation view, partially exploded and with portions broken away for clarity, of a halogen spotlight assembly in accordance with the present invention.
Figure 2:
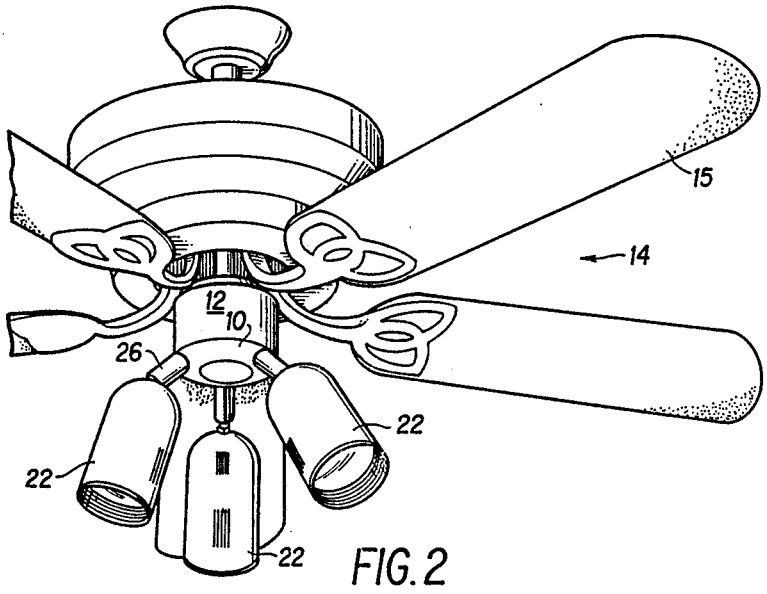
FIG. 2 is a perspective view with portions broken away showing the halogen spotlight device of the present invention mounted on a ceiling fan.

With reference to FIGS. 1 and 2, a halogen spotlight assembly according to the present invention, includes a spotlight base portion 10 that is configured for attachment to a switch housing 12 of an electrically operated ceiling fan 14 having fan blades 15. The spotlight assembly of the invention is installed after removal of a base plate (not shown) of the ceiling fan switch housing 12. In the embodiment shown, the spotlight base portion 10 has an internally flanged rim 16 that mates with the lower rim 18 of switch housing 12, for attachment to the switch housing by means of scress 20 shown in FIG. 1.

A plurality of spotlight bodies 22 are provided for housing respective halogen bulbs 24. Each spotlight body 22 is mounted on the spotlight base portion 10 by means of a pivoting ball and socket connector 26. Within each spotlight body 22 is housed an electric transformer 28 for converting electric household current (about 120 volts) to 12 volt electric current for operating a corresponding halogen bulb 24 within spotlight body 22.

Each transformer 28 includes input means **30*a* and 30*b* for connecting the transformer to a household current, and output means 32*a* and 32*b* for providing a 12 volt electric current to corresponding halogen bulb 24**.

A socket 34 is provided within the spotlight body 22 for mating with the corresponding halogen bulb 24, which may be a low voltage halogen bulb such as type MR-16 (maximum 20 watt). Socket 34 is connected to the transformer output means **3*a* and 32*b* with wires 36 and 38**.

A switch 4, which may be operated by a chain 42, is connected to transformer input **30*a* through wires 44 and 46, which, in the embodiment shown, are tied together by wire connector 48. A wire 50 connected to switch 40 is connected to a household current line by being tied to line 52 through wire connector 54, which provides means for connecting switch 40 to the household electric line for selectively connecting the transformer to the household line. In the embodiment shown, wires 52 and 56 are connected to the household electrical system 57 through switch housing 12, under the control of chain operated switch 58. Wire 56 is connected to wire 60 through wire connector 62 and to transformer input 30*b* through wire 64, which is connected to wire 60 by wire connector 66**.

During operation, light from halogen bulb 24 exits spotlight body 22 through a light outlet 68 covered by a removable window 70 that, when removed, permits access to inside of each spotlight body for installation of halogen bulbs 24. During operation, potentially damaging heat build-up from the transformer 28 and the halogen bulb 24 is prevented by upper body vents 72 and lower opposed body vents 74a and 74b. The vents allow air circulation between inside and outside the spotlight bodies to prevent potentially dangerous build-up of heat.

Since many modifications, variations and changes in detail may be made to the described embodiment, it is intended that all matter in the foregoing description and shown in the accompanying drawings be interpreted as illustrative and not in a limiting sense.

What is claimed is:

1. A halogen spotlight assembly for mounting on a ceiling fan, comprising (a) a spotlight base portion configured for attachment to a switch housing of a ceiling fan;

(b) at least one spotlight body for housing a halogen bulb, the spotlight body being mounted on said spotlight base portion by a pivoting connector, the spotlight body having a light outlet;

(c) electric transformer means housed within the spotlight assembly for converting household electric current to electric current of about 12 volts for operating a corresponding halogen bulb within the spotlight body, the transformer having an input and an output;

(d) a switch connected to the transformer input, the switch having means for connecting with a household electric line for selectively connecting the transformer to said household electric line; and (e) socket means for mating with said corresponding halogen bulb within said spotlight body, the socket means being connected to the transformer output for connecting the transformer output to said corresponding halogen bulb.

2. The assembly of claim 1 including a plurality of said spotlight bodies mounted on said base portion.

3. The assembly of claim 2 wherein each of said spotlight bodies houses one of said transformer means.

4. The assembly of claim 3 wherein each of said spotlight bodies is vented.

5. The assembly of claim 4 wherein the light outlet of each spotlight body is covered by a removable window, permitting access to inside each spotlight body.

6. The assembly of claim 1 wherein the corresponding halogen bulb is about a 20 watt halogen bulb.

7. The assembly of claim 1 wherein the pivoting connector is a ball and socket.

8. The assembly of claim 1 wherein said household electric current is about 120 volts.

9. A halogen spotlight assembly for mounting on a ceiling fan, comprising (a) a spotlight base portion configured for attachment to a switch housing of a ceiling fan;

(b) a plurality of vented spotlight bodies, each spotlight body for housing a halogen bulb, each spotlight body being mounted on said spotlight base portion by a pivoting ball and socket connector, each spotlight body having a light outlet covered by a removable window;

(c) electric transformer means housed within each spotlight body for converting household electric current of about 120 volts to an electric current of about 12 volts for operating a corresponding halogen bulb within the spotlight body, each transformer having an input and an output;

(d) a switch connected to each transformer input, the switch having means for connectihg with a household electric line of about 120 volts for selectively connecting the transformer to said household electric line; and (e) socket means for mating with said corresponding halogen bulb within each spotlight body, the socket means being connected to the corresponding transformer output for connecting the corresponding transformer output to said corresponding halogen bulb.

10. A ceiling fan with a halogen spotlight assembly, comprising (a) an electrically operated ceiling fan having rotable fan blades and a switch housing;

(b) a spotlight base portion attached to the switch housing of the ceiling fan;

(c) a plurality of vented spotlight bodies, each spotlight body for housing a halogen bulb, each spotlight body being mounted on said spotlight base portion by a ball and socket pivoting connector, each spotlight body having a light outlet covered by a removable window permitting access to inside each spotlight oody;

(d) electric transformer means housed within each spotlight body for converting household electric current of about 120 volts to an electric current of about 12 volts for operating a corresponding halogen bulb within the spotlight body, each transformer having an input and an output;

(e) a switch connected to each transformer input, the switch having means for connecting with a household electric line of about 120 volts throughout the ceiling fan for selectively connecting the transformer to said household electric line; and (f) socket means for mating with said corresponding halogen bulb within each spotlight body, the socket means being connected to the corresponding transformer output for connecting the corresponding transformer output to said corresponding halogen bulb.

* * * * *

UNITED STATES PATENT AND TRADEMARK OFFICE

CERTIFICATE OF CORRECTION

PATENT NO. : 4,796,166

DATED : January 3, 1989

INVENTOR(S) : Shelley A. Greenberg

It is certified that error appears in the above-identified patent and that said Letters Patent is hereby corrected as shown below:

Column 2, line 27, "scress" should be -- screws --;

Column 2, line 45, "3a" should be -- 32a --;

Column 2, line 47, "4" should be -- 40 --.

Column 4, line 36, "oody" should be -- body --.

Signed and Sealed this

Twenty-third Day of January, 1990

*Attest:*

JEFFREY M. SAMUELS

*Attesting Officer* *Acting Commissioner of Patents and Trademarks*